US008622322B2

(12) United States Patent
Yeager

(10) Patent No.: US 8,622,322 B2
(45) Date of Patent: Jan. 7, 2014

(54) DISPENSING APPARATUS

(75) Inventor: Don F. Yeager, Milville, NJ (US)

(73) Assignee: Amcor Limited, Hawthorn (AU)

( * ) Notice: Subject to any disclaimer, the term of this patent is extended or adjusted under 35 U.S.C. 154(b) by 327 days.

(21) Appl. No.: 12/984,761

(22) Filed: Jan. 5, 2011

(65) Prior Publication Data

US 2011/0163186 A1 Jul. 7, 2011

Related U.S. Application Data

(60) Provisional application No. 61/293,197, filed on Jan. 7, 2010.

(51) Int. Cl.

| | |
|---|---|
| ***B05B 1/34*** | (2006.01) |
| ***B05B 7/12*** | (2006.01) |
| ***B05B 1/26*** | (2006.01) |

(52) U.S. Cl.

USPC ..... 239/463; 239/416.4; 239/416.5; 239/461; 239/499

(58) Field of Classification Search

USPC ..... 239/463, 492, 506, 472, 499, 504, 590, 239/591, 468, 399, 398, 403, 406, 416.4, 239/416.5, 417.5, 418, 433, 434.5, 461

See application file for complete search history.

(56) References Cited

U.S. PATENT DOCUMENTS

| | | | | |
|---|---|---|---|---|
| 1,165,468 | A * | 12/1915 | Turnbull | 239/492 |
| 1,363,703 | A * | 12/1920 | Zimmermann | 239/492 |
| 4,020,979 | A * | 5/1977 | Shay et al. | 222/211 |
| 4,157,789 | A * | 6/1979 | Laauwe | 239/327 |
| 7,464,885 | B1 * | 12/2008 | Chang | 239/571 |

* cited by examiner

*Primary Examiner* — Justin Jonaitis

(74) *Attorney, Agent, or Firm* — Harness, Dickey & Pierce, P.L.C.

(57) ABSTRACT

A liquid dispensing apparatus includes a container having a compressible section and a tip section extending from the compressible section. The compressible section is compressible in response to actuation. The dispensing apparatus further includes a nozzle member coupled to the container that includes an orifice. Finally, the dispensing apparatus includes a fluidic channel providing fluid communication between the volume and the orifice that includes a spin chamber for imparting a spinning motion to the liquid to atomize the liquid prior to urging the liquid out of the orifice.

22 Claims, 4 Drawing Sheets

DISPENSING APPARATUS

CROSS-REFERENCE TO RELATED APPLICATIONS

This application claims the benefit of U.S. Provisional Application No. 61/293,197, filed on Jan. 7, 2010. The entire disclosure of the above application is incorporated herein by reference.

FIELD

Aspects of the present disclosure generally relate to a dispensing apparatus. Particular aspects of the present disclosure relate to a compressible tube with a nozzle through which liquid may be dispensed as a spray.

BACKGROUND

This section provides background information related to the present disclosure which is not necessarily prior art.

Dispensers for dispensing liquids and the like are known in the art. Some of these conventional dispensers dispense liquids as a spray. Aspects of this disclosure relate to innovative dispensers of liquids wherein the liquid is dispensed from a compressible tube as a spray.

SUMMARY

This section provides a general summary of the disclosure, and is not a comprehensive disclosure of its full scope or all of its features.

The present disclosure generally relates to new and novel structures for an apparatus for dispensing liquid as a spray. Particular aspects of this disclosure relate to an apparatus for expelling a liquid as a spray from the tip of a compressible or squeezable tube or other container.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figures 1A, 1B:
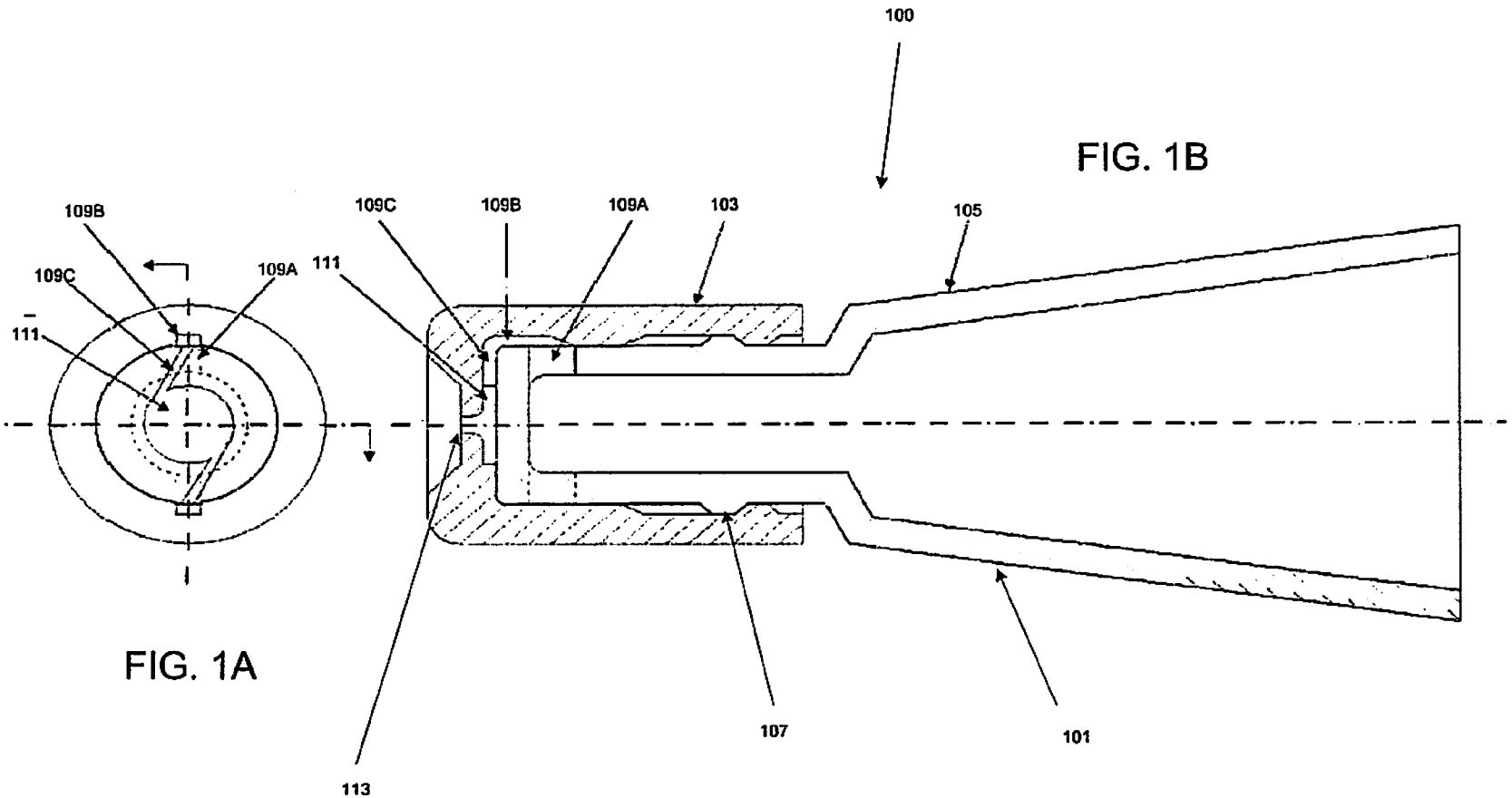
FIG. 1A is an end view of an illustrative embodiment of an apparatus for dispensing a liquid as a spray according to aspects of the disclosure.
FIG. 1B is a sectional view of the illustrative embodiment of an apparatus for dispensing a spray shown in FIG. 1A taken along the cross-sectional lines shown in FIG. 1A.
Figure 2A:
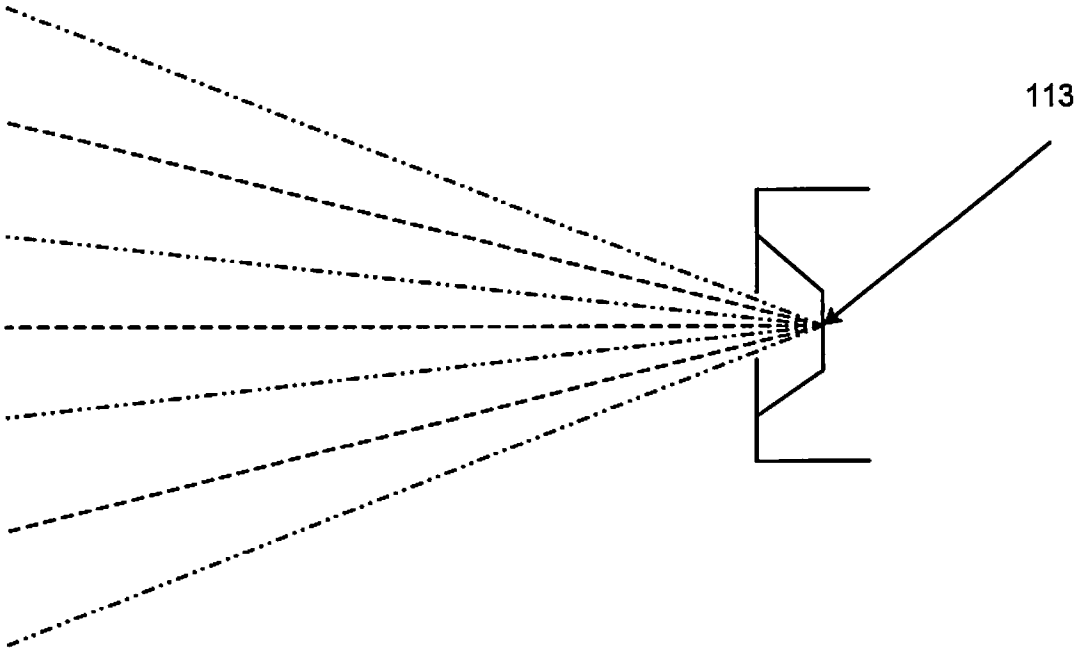
Figure 2B:
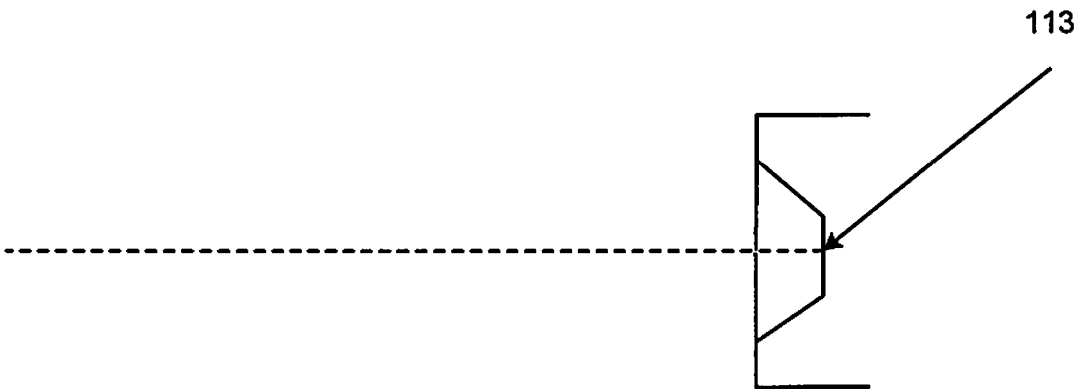
Figure 2C:
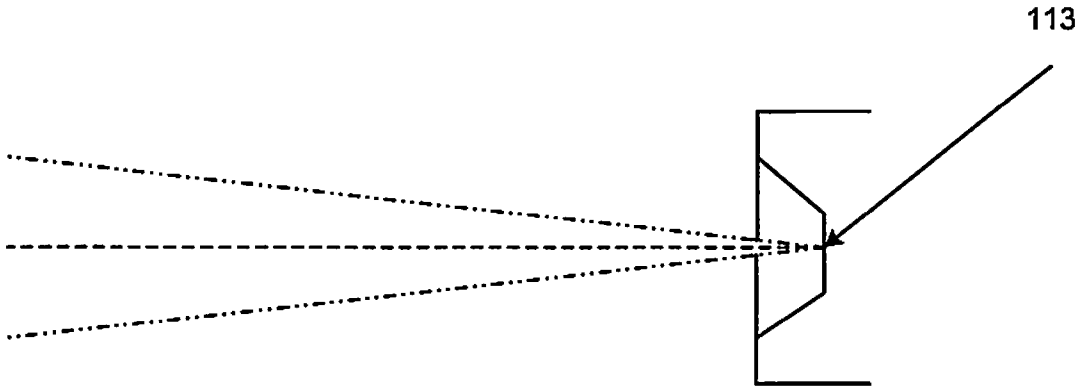

FIG. 2A schematically illustrates a spray being dispensed from the illustrative embodiment shown in FIG. 1A according to aspects of the disclosure;

FIG. 2B schematically illustrates a stream being dispensed from a dispenser according to another embodiment of the disclosure; and FIG. 2C schematically illustrates a coarse spray being dispensed from a dispenser according to another embodiment of the disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Initially, it is noted that for the sake of brevity throughout the disclosure the term "liquid" may be used to refer to any substances that may be used in a dispensing apparatus according to aspects of this disclosure. Similarly, it is noted that throughout the disclosure, for the sake of brevity, the term "spray" may be used to refer to how substances may be expelled from a nozzle of a dispensing apparatus according to aspects of this disclosure. However, this term is not intended to be limiting and may be interchangeable with other terms (e.g., mist, fine spray, coarse spray, stream, etc.) that describe how substances such as liquid may be expelled from the nozzle.

An illustrative embodiment of an apparatus for dispensing a liquid as a spray according to one aspect of the disclosure is shown at FIGS. 1A and 1B. FIG. 1A is an end view of an illustrative embodiment of an apparatus for dispensing a liquid as a spray according to aspects of the disclosure. Further, FIG. 1B is a sectional view of the illustrative embodiment shown in FIG. 1A. As shown in FIG. 1B, the dispensing apparatus 100 may include a container or tube 101 (generally referred to as "tube 101" herein) and a nozzle 103. The tube 101 may include a compressible section 105 and a tip section 107. The nozzle 103 may engage with the tip section 107 of the tube 101. According to aspects of the disclosure, the tube 101 may hold a liquid. For example, the compressible section 105 of the tube 101 may hold the liquid. As shown in FIGS. 1A and 1B, the dispensing apparatus 100 may also include channels 109*a*, 109*b*, 109*c*, a spin chamber 111 and an orifice 113 through which the liquid contained in the tube 101 may be dispensed as a spray.

The operation of the dispensing apparatus 100 is described below. As discussed above, the tube 101 may include a compressible section 105 and the compressible section 105 may contain a liquid. In order to expel the liquid from the tube 101, a user may compress the compressible section 105 of the tube 101. By compressing the compressible section 105 of the tube 101, the liquid in the tube 101 may be forced from the compressible section 105 of the tube 101 into the tip section 107. Further, the liquid may be forced from the tip section 107 through the channels 109*a*, 109*b*, 109*c*, and into a spin chamber 111. As the liquid travels around the spin chamber 111, the liquid is atomized and dispensed as a spray through the orifice 113 at the end of the nozzle 103.

Given the general description of various example aspects of the disclosure provided above, more detailed descriptions of various specific example features of dispensing apparatus structures according to the disclosure are provided below.

Initially, according to aspects of the disclosure, the dispensing apparatus may have closed (or "off") configuration and an open (or "on") configuration. It is noted that the closed configuration may be useful in preventing leaking or contamination of the liquid. In such embodiments of the disclosure, the user may rotate the nozzle 103 relative to the tube 101 to convert the dispensing apparatus 100 from a closed configuration to an open configuration.

For example, as seen in FIG. 1B, the nozzle 103 may be engaged with the tip section 107 of the tube 101. For example, as seen in FIG. 1B, the nozzle 103 may be engaged with the tip section 107 of the tube 101 by an interference fit. For example, as seen in FIG. 1B, the tip section 107 may include protrusions that interfere with grooves in the interior of the nozzle 103. According to aspects of the disclosure, the engagement means between the tube 101 and the nozzle 103 may allow for the nozzle 103 to be rotated relative to the tube 101.

Further, according to aspects of the disclosure, the dispensing apparatus 100 may include a stopping system which stops the rotation of the nozzle 103 relative to the tube 101 at particular positions. For example, according to aspects of the disclosure, the nozzle 103 and the tip 107 may each include one or more stops that will stop the rotation of the nozzle 103 relative to the tube 101 at particular positions. The stops may be positioned on the exterior of the tip 107 and the interior of the nozzle 103 so as to interfere with each other at particular positions and, thereby, stop the rotation of the nozzle relative to the tube 101 at particular positions (e.g., the open position and the closed position).

According to aspects of the disclosure, the dispensing apparatus 100 may include one or more fluidic channels for providing fluidic communication between the tube 101 and an orifice 113 of nozzle 103. For example, the dispensing apparatus 100 may include one or more of each of channels 109*a*, 109*b* and 109*c*. For example, as seen in FIG. 1A, the dispensing apparatus 100 includes two channels 109*a*, two channels 109*b*, and two channels 109*c*. The channels may be a recess or opening in either the tip section 107 or the nozzle 103, defined between the two portions (i.e., the tip section 107 or the nozzle 103) or according to aspects of the disclosure, the tube 101 and nozzle 103 may conjointly include the channels 109*a*, 109*b*, and 109*c*. For example, according to some embodiments, such as seen in FIG. 1B, the tip section 107 may include channel 109*a*. According to some embodiments, such as seen in FIG. 1B, the nozzle 103 may include channel 109*b*. According to some embodiments of the disclosure, the channel 109*c* may be included in either the tip section 107 or the nozzle 103. Further, according to some embodiments of the disclosure, the channel 109*c* may be included in the same portion (i.e., the tip section 107 or the nozzle 103) as the spin chamber 111 which will be described in detail below.

Regardless of which portion they are formed within, the channels 109*a*, 109*b* and 109*c* may be aligned with each other to form a passage or waterway. For example, according to aspects of the disclosure, when aligned, such as seen in FIG. 1B, channel(s) 109*c* may connect the channel(s) 109*b* with the spin chamber 111. Further, as seen in FIG. 1B, channel(s) 109*b* may connect with the channel(s) 109*a*. Hence, liquid may travel from the tube 101 through the channels, 109*a*, 109*b* and 109*c* to the spin chamber 111 to be dispensed through orifice 113.

It is noted that when the dispensing apparatus is positioned at particular orientations (e.g., during an intended use) channels 109*b* may be considered vertical channels while channels 109*a* and channels 109*c* are considered horizontal channels. For example, as seen in FIG. 1B, channels 109*b* may be relatively perpendicular to channels 109*a* and channels 109*c*. Hence, merely for reference purposes, channels 109*b* will be referred to as vertical channels and channels 109*a* and 109*c* will be referred to as horizontal channels.

As discussed above, the nozzle 103 may be rotated relative to the tube 101 between a first position and a second position. In the first position, vertical channel(s) 109*b* aligns with each of horizontal channel(s) 109*b* and 109*c* (e.g., as seen in FIG. 1A) such that the waterway is created. In the second position, the nozzle is rotated so that vertical channel(s) 109*b* does not align with each of horizontal channel(s) 109*a* and instead the channel 109*a* is sealed by the section of the interior of the nozzle 103. In this way, the tube 101 is sealed and leakage may be prevented. In other words, the first position would be the open position wherein the channels are aligned with each other so that 109*a* communicates with 109*b* and 109*c* in order to allow liquid to flow from the tube 101 through the channels 109 and into the spin chamber 111. The second position would be the closed position wherein the channel 109*a* is sealed. Hence, it is understood, that the nozzle 103 may be rotated relative to the tube 101 between the first (or open) position and the second (or closed) position. According to aspects of this disclosure, the first and second positions may be 90 degrees apart. For example, as seen in FIG. 1A, if the nozzle 103 were rotated 90 degrees, each of the two vertical channels 109*b* would be moved out of alignment with the horizontal channels 109*a* and 109*c* and, hence, the tube 101 would be sealed by the interior wall of the nozzle 103.

As discussed above, according to aspects of the disclosure, there may be one or multiple channels 109*a,* one or multiple channels 109*b* and one or multiple channels 109*c*. In embodiments which include multiple channels of each of 109*a,* 109*b,* 109*c,* each of the multiple channels 109*a,* 109*b,* and 109*c* may be positioned appropriately to form sets. For example, a set of two channels 109*a* may be positioned 180° from each other (e.g., as seen in FIG. 1A). As another example, a set of three channels 109*a* may be positioned 120° from each other. Sets of the other channels 109*b* and 109*c* may be positioned similarly. Further, each set of channels (e.g., 109*a*) may be positioned so that when properly aligned it may communicate with a respective set other channels (e.g., 109*b* and 109*c*) and multiple waterways may be provided. However, it is noted that according to aspects of this disclosure, that channels do not have to be formed in sets. Further it is noted, that channels 109*a,* 109*b,* 109*c* may be positioned at various increments such as 30°, 45°, 60, 90°, etc. For example, it is noted that vertical channels 109*b* may be angularly located at any angle. For example, in one embodiment the vertical channels 109*b* may be 90° apart for two positions [one off/closed and one on/open] or may be 60° apart for three positions [one off/closed and two on/open with two different spray patterns].

According to aspects of this disclosure, the nozzle 103 may include an atomizer. In the illustrative embodiment, the atomizer may be in the form of a spin chamber 111. It is noted that according to aspects of the disclosure, the spin chamber 111 may be positioned in either the nozzle 103 or the tube 101 or defined by a combination of the engagement of the nozzle 103 and the tube 101. For example, according to aspects of the disclosure, the tube 101 and nozzle 103 may conjointly include a spin chamber 111.

According to aspects of the disclosure, the waterways formed by the channels 109*a,* 109*b,* and 109*c* and communicate with the spin chamber 111 such that liquid from the tube 101 may be introduced into the spin chamber 111. As the liquid is introduced into the spin chamber, it may create a vortex in the center of the spin chamber 111 that sucks air into the spin chamber 111. For example, the liquid may flow circumferentially around the walls of the spin chamber to create the vortex. Therefore, in the spin chamber 111, the liquid is atomized by air that is brought down the center of the vortex which is created by the spinning liquid. The atomized liquid exits through the nozzle orifice 113. In some embodiments the atomized liquid may form a conical spray.

It is noted that the angle at which the channel 109*c* connects the vertical channel 109*b* with the spin chamber 111 may affect how the liquid is dispensed from the dispensing apparatus. For example, if the channel 109*c* connects to the spin chamber 111 at an angle such as at a tangent as shown in FIG. 1A, then when the liquid is introduced to the spin chamber 111, a fine mist may be produced. FIG. 2A schematically illustrates a fine mist being dispensed from the illustrative embodiment shown in FIG. 1 according to aspects of the disclosure. Alternatively, if the channel 109*c* connects with the spin chamber 111 without being angled (e.g., on a direct path from the vertical channel 109*b* shown in FIG. 1A or toward the center of the spin chamber 111), then when the liquid is introduced to the spin chamber 111, a stream is produced. FIG. 2B schematically illustrates a stream being dispensed from the illustrative embodiment according to aspects of the disclosure. Alternatively, if the channel 109*c* connects the vertical channel with the spin chamber 111 at an intermediate angle, then when the liquid is introduced to the spin chamber 111, a more coarse mist is produced. FIG. 2C schematically illustrates a coarse mist being dispensed from the illustrative embodiment according to aspects of the disclosure. Hence, it is understood that the greater the angle at which the horizontal channel 109*c* connects the vertical channel with the spin chamber 111, the finer the spray will be. Hence, it is also understood, that the channels 109*c* may be configured such that they are directed at various angles to get a course spray, fine spray, mist or other type of spray pattern. According to aspects of this disclosure, a tube 101 and spray nozzle 103 conjointly may have an almost infinitely adjustable spray pattern. Further, while according to aspects of the disclosure, one set of horizontal channels 109*c* may be included in the dispensing apparatus 100 (such as shown in FIG. 1A), alternatively, according to other aspects of the disclosure, several sets of horizontal channels 109*c* (e.g., two or three sets) may be included in a single dispensing apparatus 100 so that the type of spray may be varied as desired.

According to some embodiments of this disclosure, the compressible section 105 of the tube 101 may have a larger diameter or cross-section than the diameter or cross section of the tip 107. Further, the diameter or cross section of the tip section 107 may be smaller than the diameter or cross section of the nozzle 103. Additionally, the wall of the compressible section 105 may be tapered from a first end, which is farthest from the nozzle 103, towards a second end, which is adjacent the nozzle 103 so that the compressible section 105 narrows as it approaches the nozzle 103.

According to some aspects of this disclosure, the tube 101 may be made of a plastic material such as polypropylene, high density polyethylene, low density polyethylene, polyethylene terephthalate (PET) or some other type of plastic. For example, the compressible section 105 and the tip section 107 may each be made from polypropylene. Further, the nozzle 103 may be made from polypropylene. Additionally, other structures in the dispensing apparatus 100, such as the atomizer may be made from a plastic material such as polypropylene, high density polyethylene, low density polyethylene, polyethylene terephthalate (PET) or some other type of plastic. According to some embodiments of this disclosure, the entire tube 101 may be made from a single material and the wall thicknesses of the different sections (e.g., the compressible section 105, the tip section 107) are varied in order to provide appropriate rigidity. For example, according to one embodiment the tube is made of polypropylene and the wall thickness of tip section 107 may be approximately twice the wall thickness of the compressible section 105. In this way, the tip section 107 is more rigid than the compressible section 105. A more rigid tip may be desirable as it will prevent buckling. However, this is merely one embodiment. Of course, according to different embodiments, different portions of the dispensing apparatus may be of different materials (e.g., rubber, foil, or other materials), have different thicknesses, different rigidities, etc. For example, the tip section 107 and the nozzle 103 may be made from different materials that are more rigid than the compressible section 105.

According to aspects of this disclosure, the dispensing apparatus 100 may be created by forming the tube 101 out of polypropylene, high density polyethylene, low density polyethylene, or some other type of plastic. This may be done via conventional processes such as molding, etc. Further, the liquid may then be placed into the compressible section 105 of the tube 101. Additionally, once the fluid is within the tube 101, the tube 101 may be sealed. For example, the end of the compressible section 105 may be heat sealed via a crimping means. The above described process for forming the dispensing apparatus 100 is merely an example of one such process by which the dispensing apparatus may be formed and, of course, different variations of the process or other processes may be used.

Particular aspects of the disclosure may relate to a dispenser configured for dispensing a liquid (e.g., a medicine or other chemical) in a nasal passageway. For example, according to some embodiments of this disclosure, the nozzle 103 may be sized to fit comfortably in the nasal cavity. Such nasal application embodiments may provide the pharmaceutical industry with an innovative dispensing package that will expel liquid as a spray or mist from the tip of a squeezable tube or other container.

Particular substances that may be used in conjunction with such an embodiment of the disclosure may include: NASOBOL (Itra-nasal Testoserone), ANDRODERM, NOSEAFIX, Bepotastine, Civamide, Ereska, FluNsure, Intranasal Diazepam, Midazoam, Morphine Gluconate, Nasal LORAZEPAM, NASCOBAL, Pieconaril, Rylomine, and SinuNase.

According to some aspects of this disclosure, the overall length of the dispensing apparatus 101 may be in the range of 2 inches or less. Further, according to aspects of the disclosure, the channels, such as horizontal channel 109*c* may be in the range of 0.01 to 0.02 inch. However, these dimensions are merely illustrative and other sizes and ranges may be used as well. In fact, the sizes and ranges may vary dramatically depending on the use. For example, a dispenser for the nasal passage is this is merely one embodiment of the disclosure and, therefore, should not be construed as limiting.

It is noted that according to aspects of the disclosure, a dispensing apparatus has relatively few parts. For example, conventional dispensers, such as trigger sprayers may contain 13 or more parts. Hence, in contrast to such dispensers, a dispensing apparatus according to aspects of the disclosure, may be advantageous in that it may have less parts, require less assembly time, be cheaper to manufacture, etc.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A dispensing apparatus for dispensing a liquid, said dispensing apparatus comprising:

a container having a compressible section and a tip section extending from said compressible section, said compressible section being compressible in response to actuation, said container having a volume for containing the liquid;

a nozzle member coupled to said container, said nozzle member having an orifice; and a fluidic channel providing fluid communication between said volume and said orifice, said fluidic channel having a spin chamber for imparting a spinning motion to the liquid to atomize the liquid prior to urging the liquid out of said orifice;

wherein said fluidic channel is selectively positionable between an opened position providing said fluid communication between said volume and said orifice and a closed position preventing said fluid communication between said volume and said orifice, and wherein said nozzle member is rotatable relative to said container to position said fluidic channel between said opened position and said closed position.

2. The dispensing apparatus according to claim 1 wherein said fluidic channel comprises:

a first channel extending through said tip section of said container; and a second channel extending from said first channel to said spin chamber.

3. The dispensing apparatus according to claim 1 wherein said fluidic channel comprises:

a first channel extending through said tip section of said container;

a second channel extending orthogonally from said first channel; and a third channel extending orthogonally from said second channel to said spin chamber.

4. The dispensing apparatus according to claim 3 wherein said third channel connects with said spin chamber to form an angle between an axis of said third channel and a center of said spin chamber.

5. The dispensing apparatus according to claim 3 wherein said third channel connects to said spin chamber at a tangent to said spin chamber.

6. The dispensing apparatus according to claim 3 wherein said third channel connects with said spin chamber to form an atomized spray of the liquid from said orifice.

7. The dispensing apparatus according to claim 1 wherein a wall thickness of said compressible section is less than a wall thickness of said tip section.

8. A dispensing apparatus for dispensing a liquid, said dispensing apparatus comprising:

a container having a compressible section and a tip section extending from said compressible section, said compressible section being compressible in response to actuation, said container having a volume for containing the liquid;

a nozzle member coupled to said container, said nozzle member having an orifice;

a spin chamber formed between or in at least one of said container and said nozzle, said spin chamber being in fluid communication with said orifice and operable for imparting a spinning motion to the liquid to atomize the liquid prior to urging the liquid out of said orifice;

a first fluidic channel providing fluid communication between said volume and said spin chamber; and a second fluidic channel providing fluid communication between said volume and said spin chamber, said second fluidic channel being separate from said first fluidic channel;

wherein said first fluidic channel and said second fluidic channel are selectively positionable between an opened position providing said fluid communication between said volume and said orifice and a closed position preventing said fluid communication between said volume and said orifice, and wherein said nozzle member is rotatable relative to said container to position said first fluidic channel and said second fluidic channel between said opened position and said closed position.

9. The dispensing apparatus according to claim 8 wherein said first fluidic channel includes a first section extending through said tip section of said container, a second section extending orthogonally from said first section, and a third section extending orthogonally from said second section to said spin chamber.

10. The dispensing apparatus according to claim 9 wherein said second fluidic channel includes a fourth section extending through said tip section of said container, a fifth section extending orthogonally from said fourth section, and a sixth section extending orthogonally from said fifth section to said spin chamber.

11. The dispensing apparatus according to claim 10 wherein said third section and said sixth section enter said spin chamber as positions about 180° apart.

12. A dispensing apparatus for dispensing a liquid, said dispensing apparatus comprising:

a container having a compressible section and a tip section extending from said compressible section, said compressible section being compressible in response to actuation, said container having a volume for containing the liquid;

a nozzle member coupled to said container, said nozzle member having an orifice; and a fluidic channel providing fluid communication between said volume and said orifice, said fluidic channel having a spin chamber for imparting a spinning motion to the liquid to atomize the liquid prior to urging the liquid out of said orifice;

wherein said fluidic channel is selectively positionable between an opened position providing said fluid communication between said volume and said orifice and a closed position preventing said fluid communication between said volume and said orifice, and wherein said nozzle member is rotatable relative to said container to interrupt said fluid communication of said fluidic channel.

13. The dispensing apparatus according to claim 12 wherein said fluidic channel comprises:

a first channel extending through said tip section of said container; and a second channel extending from said first channel to said spin chamber.

14. The dispensing apparatus according to claim 12 wherein said fluidic channel comprises:

a first channel extending through said tip section of said container;

a second channel extending orthogonally from said first channel; and a third channel extending orthogonally from said second channel to said spin chamber.

15. The dispensing apparatus according to claim 14 wherein said third channel connects with said spin chamber to form an angle between an axis of said third channel and a center of said spin chamber.

16. The dispensing apparatus according to claim 14 wherein said third channel connects to said spin chamber at a tangent to said spin chamber.

17. The dispensing apparatus according to claim 14 wherein said third channel connects with said spin chamber to form an atomized spray of the liquid from said orifice.

18. The dispensing apparatus according to claim 12 wherein a wall thickness of said compressible section is less than a wall thickness of said tip section.

19. A dispensing apparatus for dispensing a liquid, said dispensing apparatus comprising:

a container having a compressible section and a tip section extending from said compressible section, said compressible section being compressible in response to actuation, said container having a volume for containing the liquid;

a nozzle member coupled to said container, said nozzle member having an orifice;

a spin chamber formed between or in at least one of said container and said nozzle, said spin chamber being in fluid communication with said orifice and operable for imparting a spinning motion to the liquid to atomize the liquid prior to urging the liquid out of said orifice;

a first fluidic channel providing fluid communication between said volume and said spin chamber; and a second fluidic channel providing fluid communication between said volume and said spin chamber, said second fluidic channel being separate from said first fluidic channel;

wherein said first fluidic channel and said second fluidic channel are selectively positionable between an opened position providing said fluid communication between said volume and said orifice and a closed position preventing said fluid communication between said volume and said orifice, and wherein said nozzle member is rotatable relative to said container to interrupt said fluidic communication of said first fluidic channel and said second fluidic channel.

20. The dispensing apparatus according to claim 19 wherein said first fluidic channel includes a first section extending through said tip section of said container, a second section extending orthogonally from said first section, and a third section extending orthogonally from said second section to said spin chamber.

21. The dispensing apparatus according to claim 20 wherein said second fluidic channel includes a fourth section extending through said tip section of said container, a fifth section extending orthogonally from said fourth section, and a sixth section extending orthogonally from said fifth section to said spin chamber.

22. The dispensing apparatus according to claim 21 wherein said third section and said sixth section enter said spin chamber as positions about 180° apart.

* * * * *